US008204425B2

(12) United States Patent
Rodriguez et al.

(10) Patent No.: US 8,204,425 B2
(45) Date of Patent: Jun. 19, 2012

(54) WASTE DRY INK SYSTEM WITH PRESSURE EQUALIZING HERMETICALLY SEALED OUTER BOX

(75) Inventors: Jorge M. Rodriguez, Webster, NY (US); Ali R. Dergham, Fairport, NY (US); Scott M. Dailey, Webster, NY (US); Mark A. Adiletta, Fairport, NY (US)

(73) Assignee: Xerox Corporation, Norwalk, CT (US)

( * ) Notice: Subject to any disclaimer, the term of this patent is extended or adjusted under 35 U.S.C. 154(b) by 294 days.

(21) Appl. No.: 12/640,839

(22) Filed: Dec. 17, 2009

(65) Prior Publication Data

US 2011/0081180 A1 Apr. 7, 2011

Related U.S. Application Data

(63) Continuation-in-part of application No. 12/572,334, filed on Oct. 2, 2009, and a continuation-in-part of application No. 12/572,308, filed on Oct. 2, 2009.

(51) Int. Cl.
*G03G 21/12* (2006.01)

(52) U.S. Cl. ..... 399/360; 399/109

(58) Field of Classification Search ..... 399/38, 399/75, 107, 109, 120, 343, 358, 360; 222/DIG. 1
See application file for complete search history.

(56) References Cited

U.S. PATENT DOCUMENTS

| | | | | |
|---|---|---|---|---|
| 5,260,755 | A * | 11/1993 | Imaizumi | 399/35 |
| 5,493,382 | A * | 2/1996 | Takagaki et al. | 399/359 |
| 2006/0083540 | A1 * | 4/2006 | Kadowaki et al. | 399/102 |
| 2008/0118290 | A1 * | 5/2008 | Sato | 399/358 |

FOREIGN PATENT DOCUMENTS

| | | | |
|---|---|---|---|
| JP | 61059470 | A * | 3/1986 |
| JP | 05043747 | A * | 2/1993 |

* cited by examiner

*Primary Examiner* — David Porta
*Assistant Examiner* — Benjamin Schmitt
(74) *Attorney, Agent, or Firm* — Ronald E. Prass, Jr.; Prass LLP

(57) ABSTRACT

This is a novel xerographic marking system having a novel toner waste dispensing assembly. The assembly comprises a hermetically sealed outer box that houses a disposable waste toner container. The container is a biodegradable carton or bag that can be removed from the outer box when filled with waste toner. A feature of this invention is that the dispensing assembly can easily be retrofitted into existing marking systems. Also because the containers are inexpensive and biodegradable, the expensive prior art non-degradable waste containers and their adverse effect on the landfills can be avoided.

16 Claims, 9 Drawing Sheets

WASTE DRY INK SYSTEM WITH PRESSURE EQUALIZING HERMETICALLY SEALED OUTER BOX

This application is a Continuation in Part of U.S. application Ser. No. 12/572,334 and 12/572,308 filed in the US Patent and Trademark Office on Oct. 2, 2009.

This invention relates to a xerographic marking system and, more specifically, to a dry ink waste dispensing assembly using substantially the same pressure as existing disposal assemblies.

CROSS REFERENCE TO RELATED APPLICATIONS

Illustrated and disclosed in pending parent application Ser. No. 12,572,334 and Ser. No. 12/572,308 owned by the present assignee are applications relating to controlled, waste dispenser assemblies using a disposable bag by controlling or adjusting pressure in the system.

BACKGROUND

By way of background, an electrophotographic or electrostatographic reproduction machine employs a photoconductive member (a belt or a drum) that is charged to a substantially uniform potential so as to sensitize the surface thereof. The charged portion of the photoconductive member is exposed to a light image of an original document being reproduced. Exposure of the charged photoconductive member selectively dissipates the charge thereon in the irradiated areas to record an electrostatic latent image on the photoconductive member corresponding to the informational areas contained within the original document.

After the electrostatic latent image is recorded on the photoconductive member, the latent image is developed by bringing a developer material into contact therewith. Generally, the electrostatic latent image is developed with dry developer material comprising carrier granules having toner particles adhering triboelectrically thereto. However, a liquid developer material may be used as well. The toner particles are attracted to the latent image, forming a visible powder image on the photoconductive surface. After the electrostatic latent image is developed with the toner particles, the toner powder image is transferred to a sheet. Thereafter, the toner image is heated to permanently fuse it to the sheet.

It is highly desirable to use an electrostatographic reproduction machine to produce color prints. In order to produce a color print, the electrostatographic reproduction machine includes a plurality of stations. Each station has a charging device for charging the photoconductive surface, an exposing device for selectively illuminating the charged portions of the photoconductive surface to record an electrostatic latent image thereon, and a developer or station for developing the electrostatic latent image with toner particles. Each developer station deposits different color toner particles on the respective electrostatic latent image. The images are developed, at least partially in superimposed registration with one another, to form a multi-color toner powder image.

Excess toner is eliminated from the machine and waste toner is collected in a waste toner container and then removed when filled and disposed of, since in color systems waste toner cannot be reused.

Some xerographic or electrophotographic machines exhaust waste dry ink (toner) at a rate of approximately 320 grams/hour (actual rate varies with job area coverage, stock size, toner aging purge parameters and manifold emissions).

At this rate a current used Waste Dry Ink Container has to be replaced approximately every 25 hours. Furthermore, the waste container has stringent strength requirements: sustain 12 inches wg vacuum pressure and hold 10 Kg. weight.

Because of the high waste rate and stringent strength requirements, a very expensive plastic container is currently used in several machines. The high replacement rate leads to about 63,000 kilograms of plastic waste per year per family of machines. Furthermore, a very expensive custom designed sensor needs to be used to match the properties and tolerances of the complex prior art waste containers.

Designing a simpler, biodegradable waste container dispense assembly would make the electrophotographic marking apparatus a greener machine by reducing plastic waste in the landfill. It would also reduce the piece part cost of a high prior art replacement item.

SUMMARY OF THE INVENTION

The invention proposes the use of a stationary hermetically sealed box with a removable, less expensive carton or bag container inside, which will collect the waste particles and be disposed of when it is full. Furthermore, the new design will eliminate the costly sensors; a scale will be used instead. This will reduce cost and provide for continued accuracy. Using a hard, thick, expensive plastic container will no longer be necessary. The new waste assembly utilizes a stationary hermetically sealed outer box to withstand the vacuum pressure applied by the cyclone separators. The removable waste container that fits into the outer box is biodegradable; it is either a carton or a bag, placed inside leaving an air gap at each interior face to the outer box. A porous material is placed between the removable waste container and the stationary hermetically sealed outer box. When the cyclone separator applies vacuum to the system, the pressure passes through the porous material to the stationary hermetically sealed outer box. The porous material stops waste particles and prevents contamination of the stationary outer box. Test results showed the cyclone system of this invention is 98.5% efficient with the new disposable and biodegradable waste container. This means that 98.5% of the waste toner particles are collected in the waste container and only 1.5% is collected in the filter. As an example, for every container replacement (20 lb. of waste toner), 0.3 lb. of toner is collected at the filter and the remainder captured in the removable container of this invention. This represents one of the most efficient and economical toner waste collection system we have tested to date. Several test runs were conducted and each proved at least 98% efficient.

Therefore, this invention provides a novel assembly for the waste dry ink container in electrostatic marking systems. The new system uses a biodegradable carton waste container. It also drastically reduces the cost of each waste container and sensor, if needed. The new assembly is a stationary hermetically sealed box with a removable, inexpensive disposable carton or bag container inside, which will collect the waste particles and be disposed of when it is full. The new assembly will eliminate the costly sensors; a scale placed under the disposable container will be used instead. Advantages of the present invention include reduced costs without loss of functionality. Other advantages are that the assembly of this invention is very efficient and can be easily retrofitted into existing xerographic marking systems.

This invention provides a toner waste collection assembly to replace the existing waste collection container for dry ink. The requirements of high fill rate and mass and internal vacuum lead in the prior art to frequent replacement of a thick, expensive plastic container. In this invention a waste assembly is provided that eliminates the need to use very expensive waste containers that are not biodegradable. Also, as earlier noted, the use of expensive sensors is eliminated. This allows an inexpensive biodegradable removable container to be used. This invention provides a cheaper, removable container that can be used if it is inserted into a reusable stationary hermetically sealed box.

While the collection container will be described herein as a "carton" or "bag", other inexpensive collection containers may be used, if suitable, such as degradable boxes or other degradable paper or plastic collectors; these are included in the term "container" as used in this disclosure.

The collection container of the present invention can easily be retrofitted into those existing toner waste collection stations presently being used. It is important that the containers used be UL approved or have similar private or governmental approval and acceptance.

DETAILED DISCUSSION OF DRAWINGS AND PREFERRED EMBODIMENTS

Figure 1:
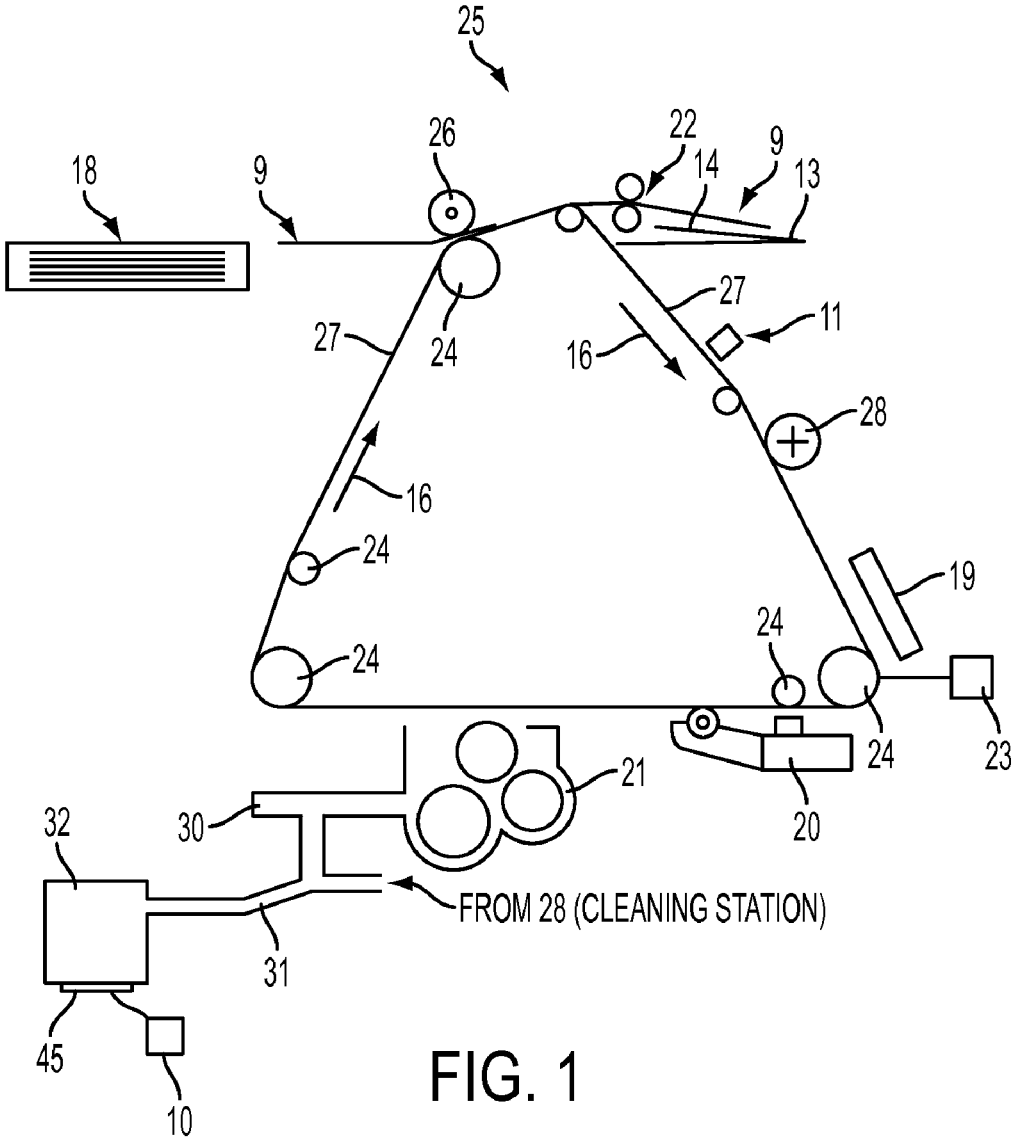
FIG. 1 is a schematic view of an electrophotographic marking system that can utilize the toner collection assembly of the present invention.

In FIG. 1, for ease of understanding, a monochromatic electrophotographic marking system is shown. It should be noted, however, that multi-station color systems not shown that use from 4-6 units of xerographic system 25 illustrated in FIG. 1 are within the scope of this invention. While both monochromatic and multi unit color system are within this invention, use of the toner waste collection assembly 32 of this invention is most beneficial in multi-unit color systems where 4-6 different colored toners are used and much more toner waste occurs. In FIG. 1 the following numbers are used to designate the following Xerographic system components.

In FIG. 1 the following are illustrated:

9. paper
10. controller connected to scale 45
11. image sensor for paper image quality
13. stacking assembly
14. collection station
16. arrows of belt movement
18. paper feed
19. charging station
20. exposure station
21. developer station
22. fusing station
23. motor
24. rollers
25. xerographic system
26. transfer station
27. photoconductor belt
28. cleaning station In developer station 21 and in cleaning station 28 where excess toner occurs, waste housing 30 accumulates waste toner 43 and other debris and transports it via collection tubes 31 to the waste collector assembly 32 of this invention. While FIG. 1 only shows one waste housing 30 and collection tubes 31, multiple xerographic developer stations of a color system will have multiple waste housings 30 and multiple collection tubes 31 (as shown in FIG. 4 herein). Multiple xerographic units with multiple collection tubes 31 and a typical toner using color system is illustrated in U.S. application Ser. No. 12/189,379 which is incorporated by reference into the present disclosure. For clarity, the specifics of waste collector 32 of this invention are not shown in FIG. 1, but are shown in detail in FIGS. 3-9.

Figure 2:
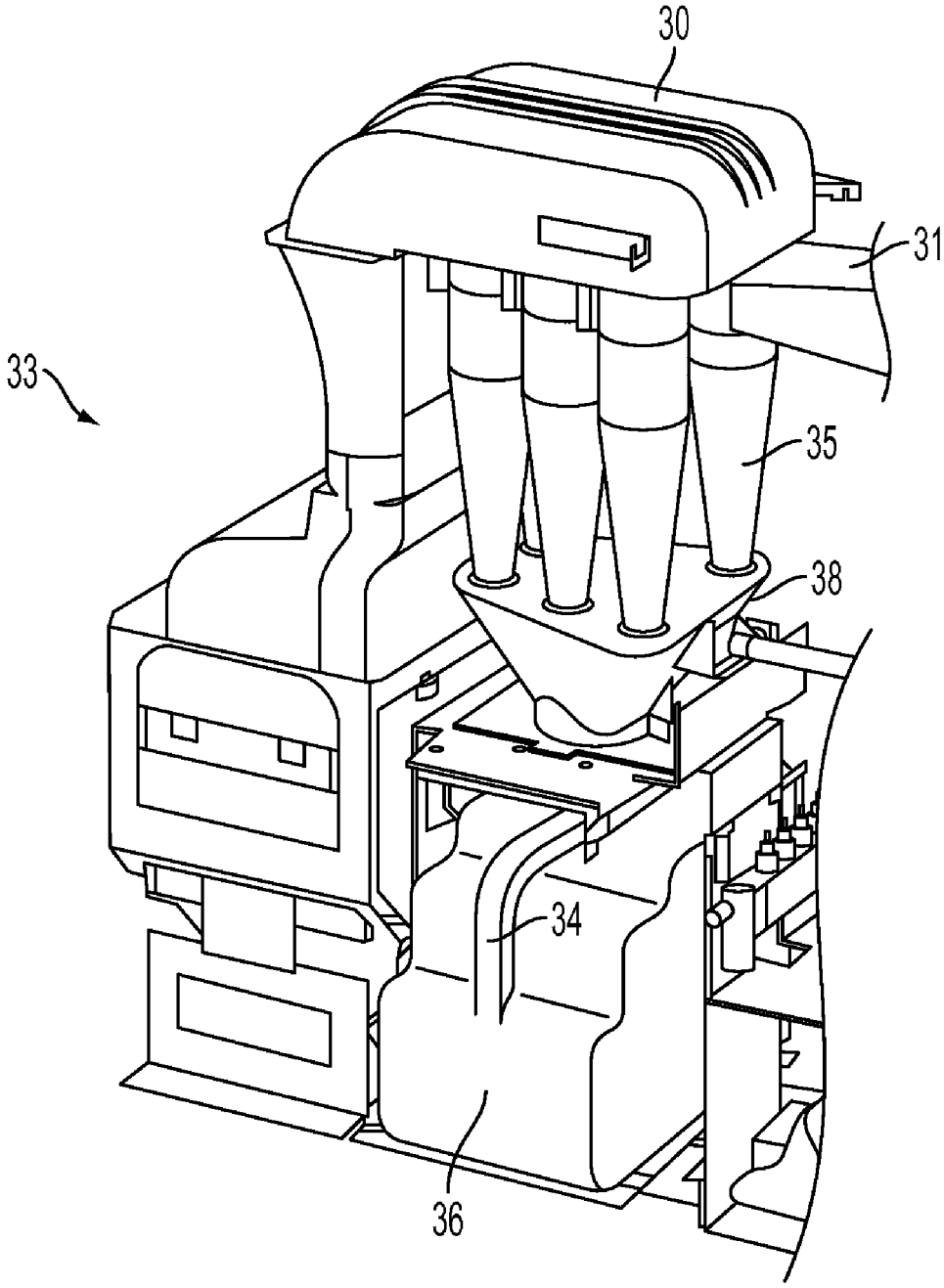
FIG. 2 PRIOR ART
FIG. 2 is a front view of a prior art waste toner collection apparatus using a hard thick plastic collection container.

In FIG. 2 a collection unit 33 of the prior art is shown where an expensive prior art waste dry ink or toner container 36 is used with a removal handle 34. Here the cyclone separators 35 apply a vacuum pressure on the rigid waste container 36. A typical prior art marking system exhausts waste dry ink (toner) at a rate of approximately 320 grams per hour. At this rate, the current expensive prior art waste dry ink container 36 has to be replaced approximately every 25 hours. This prior art waste container 36 has stringent strength requirements such as sustain 6 inches wg vacuum pressure and hold 20 lb. waste; because of these requirements, a very expensive plastic, non-biodegradable container 36 must currently be used. The high replacement rate of these prior art containers 36 leads to about 35 tons of plastic waste per year for one family of machines. Providing a simpler waste dispense assembly 32 of this invention would make these machines greener by substantially reducing plastic waste in the landfill. It would also reduce the part price cost of a high replaced item, i.e. container 36. Collection tubes 31 lead to cyclone separators 35, the cyclone separator 15 applies a vacuum pressure on the waste container 36. This vacuum pressure exists also in container 36 which accounts for the necessity of rigidity and thickness in container 36. The disposable container 39 of the present invention together with the stationary hermetically sealed outer box 37 replaces the expensive prior art container 36 which when filled is pulled out of the prior art assembly 33 and discarded in a landfill, thereby causing some pollution concerns.

Figure 3:
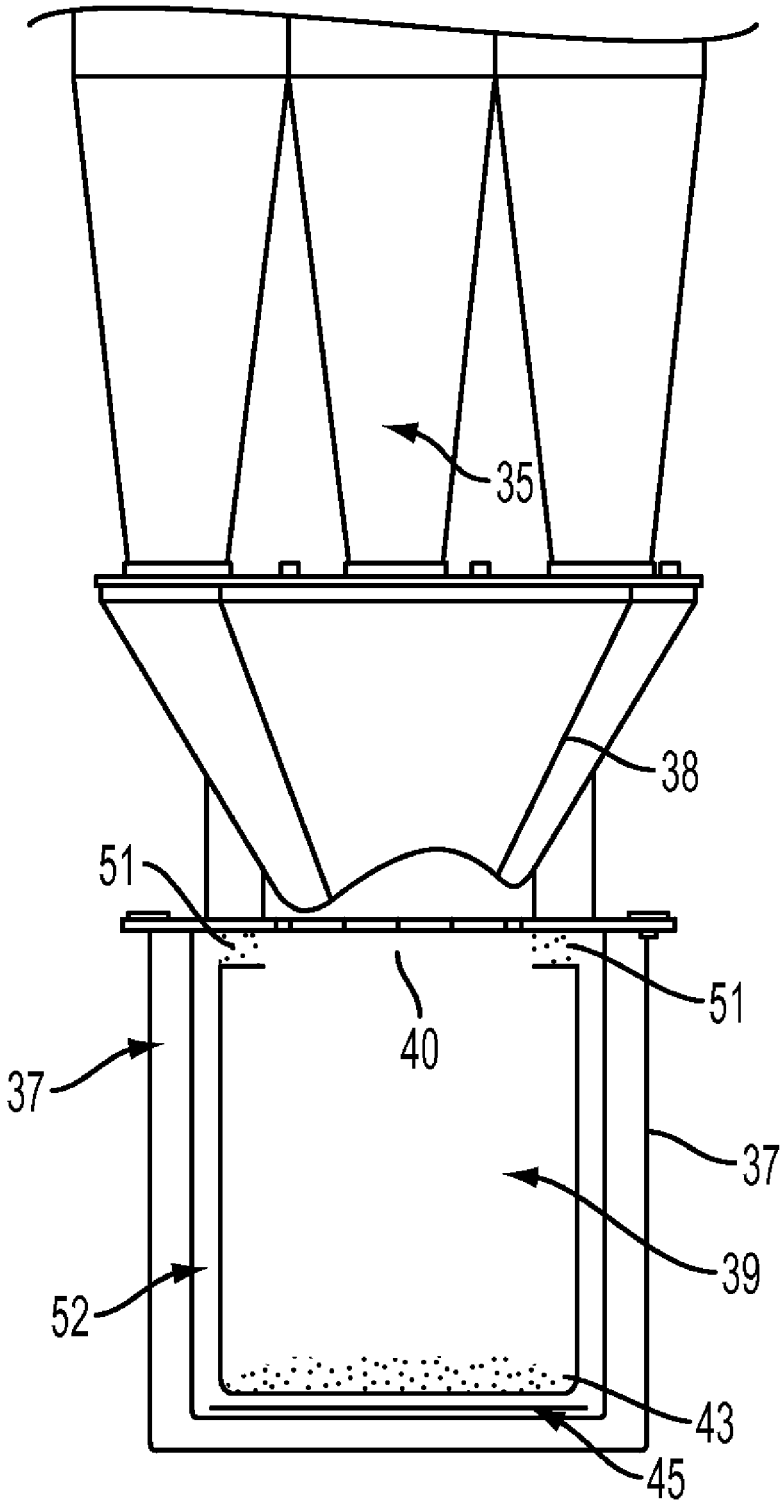
FIG. 3 is a removable degradable collection and a container inserted into a stationary hermetically sealed outer box.
Figure 4:
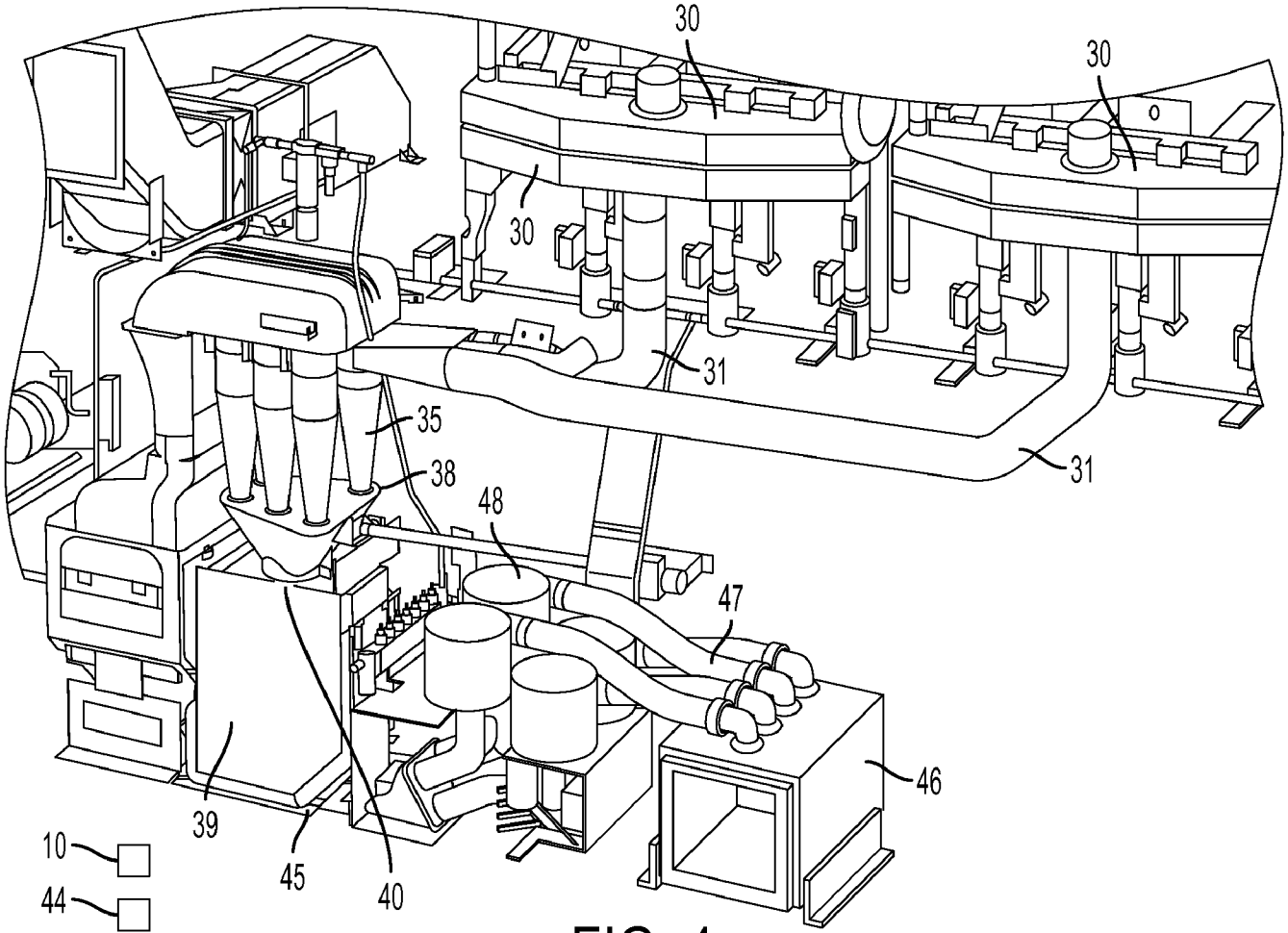
FIG. 4 is a perspective view of the collection assembly of this invention as it is connected to the developer stations of an electrophotographic marking system.

In FIG. 3 a part of the waste collection assembly 32 of this invention is shown where a removable container 39 with an opening 40 is used in place of prior art plastic container 36. When the cyclone separators 35 apply vacuum to the system, the pressure passes through the porous material 51 into the interior of the hermetically sealed outer box 37. The porous material 51 stops waste particles 43 and prevents contamination of the stationary outer box 37. The sensor scale 45 is connected to a controller 10 which will stop feeding waste particles 43 into container 39 when the container 39 is full and ready to be removed from outer box 37. The porous material 51 allows the pressure to rapidly equalize in the air gap 52 around the removable waste container 39 preventing suck-up or collapse. Outer box 37, as shown in FIGS. 5-9 has a door 53 for the removal and insertion of collector container 39.

In FIG. 4 waste housings 30 from different and multiple developer stations of a color printer are shown as they are connected to waste collection tubes 31. The tubes 31 transport waste toner 43 from the color developer stations to cyclone separators 35 which fields the waste toner 43 into funnel 38 to container 39 of this invention. The funnel carries waste toner 43 into degradable container 39 to be removed when full. Below the container 39 is a weight scale 45 which indicates when the container 39 is full of waste toner 43 and needs to be removed and replaced with a new container 39. This FIG. 4 illustrates a portion of a multi-color xerographic unit having at least two separate development stations connected to waste housings 30 and collection tubes 31. The scale 45 when it reaches a certain fixed weight will contact the controller 10 via sensors which will tell the motor to shut down and cause the loading to stop when the container 39 is filled. Components shown in FIG. 4 that do not constitute part of the collection unit of the present invention but shown for understanding and clarity are air collectors 46 and exhaust tubes 47 and vacuum blowers 48.

Figure 5:
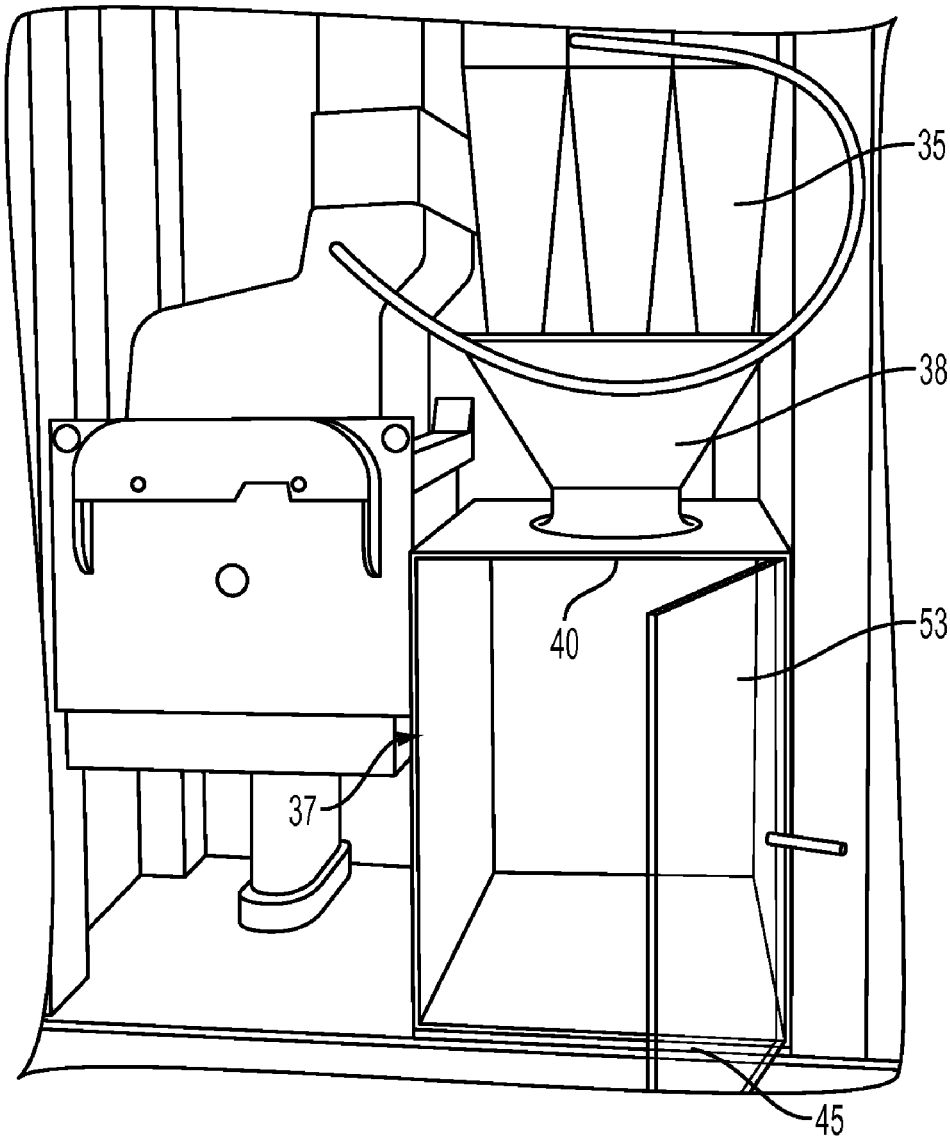
FIG. 5 is an expanded view of the stationary non-removable hermetically sealed outer box used in this invention that contains the collection carton or bag.

In FIG. 5, an expanded view of the outer box 37 of this invention is shown where the side door opening 53 of the hermetically sealed outer box 37 is opened ready for the insertion or removable waste toner container 39 (not shown in FIG. 5). The scale 45 is shown in position (either below the container 39 or below the outer box 37) where it will indicate the weight of container 39 when it is full and requires removal from outer box 37. Once the full container 39 has been removed, a new container 39 is placed in box 37 below funnel 38 for receiving waste toner from the system via funnel 38 and the controller 10 will restart the waste toner collection. The porous ring or material 51 may be part of the outer box 37 or may be attached to a top portion of removable container 39, as shown in FIG. 8.

Figure 6:
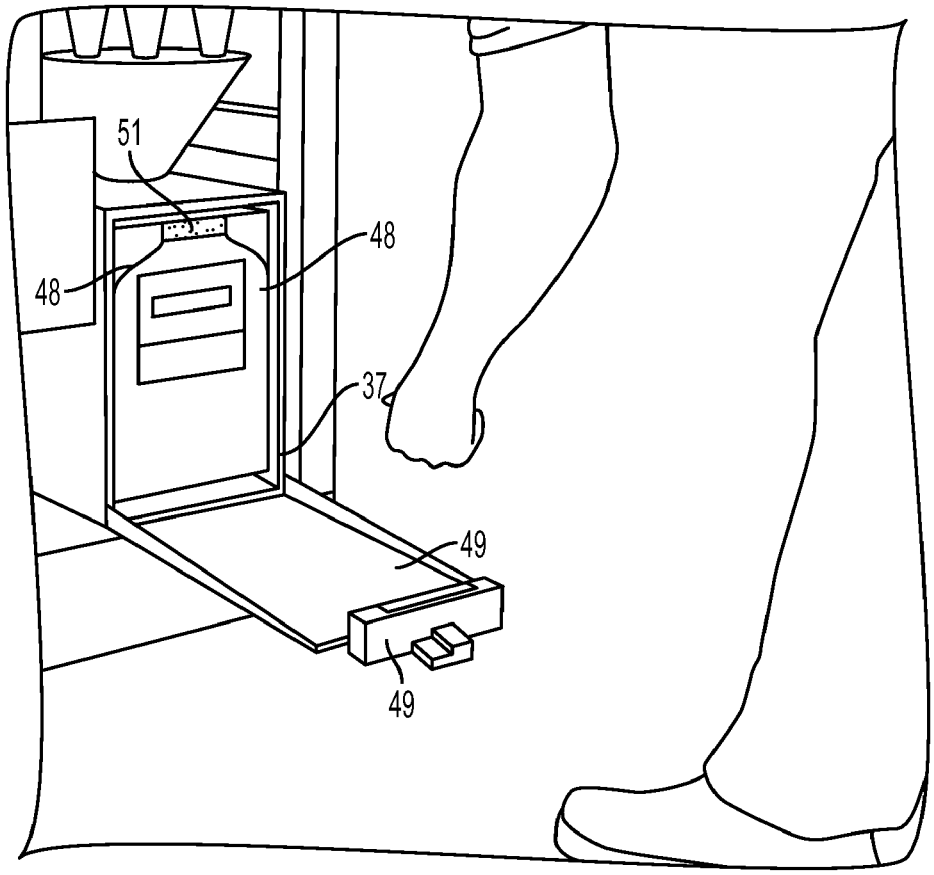
FIG. 6 is a perspective view of a bag container before it is removed from the hermetically sealed outer box.

In FIG. 6 a bag container 48 is shown as it is positioned in the outer box 37. The drop door 49 is opened to permit access to outer box 37. The porous material or ring 51 is shown attached to the top of bag container 48 but this porous ring may be optionally part of the stationary outer box 37, if suitable. The purpose of the porous (or foam) ring 51, as earlier noted, is to permit pressure to pass through it and around the container 48 to equalize the pressure around the container 48 to prevent it from collapsing. Also the porous material or foam 51 acts as a seal and prevents toner from falling to the sides of the container 48. The shapes of the container 48 are shown in the figures as rectangular; however, any suitable shape container 48 may be used. Also, the bag container 48, if necessary, can have any internal structures or inserts to help keep it from collapsing.

Figure 7:
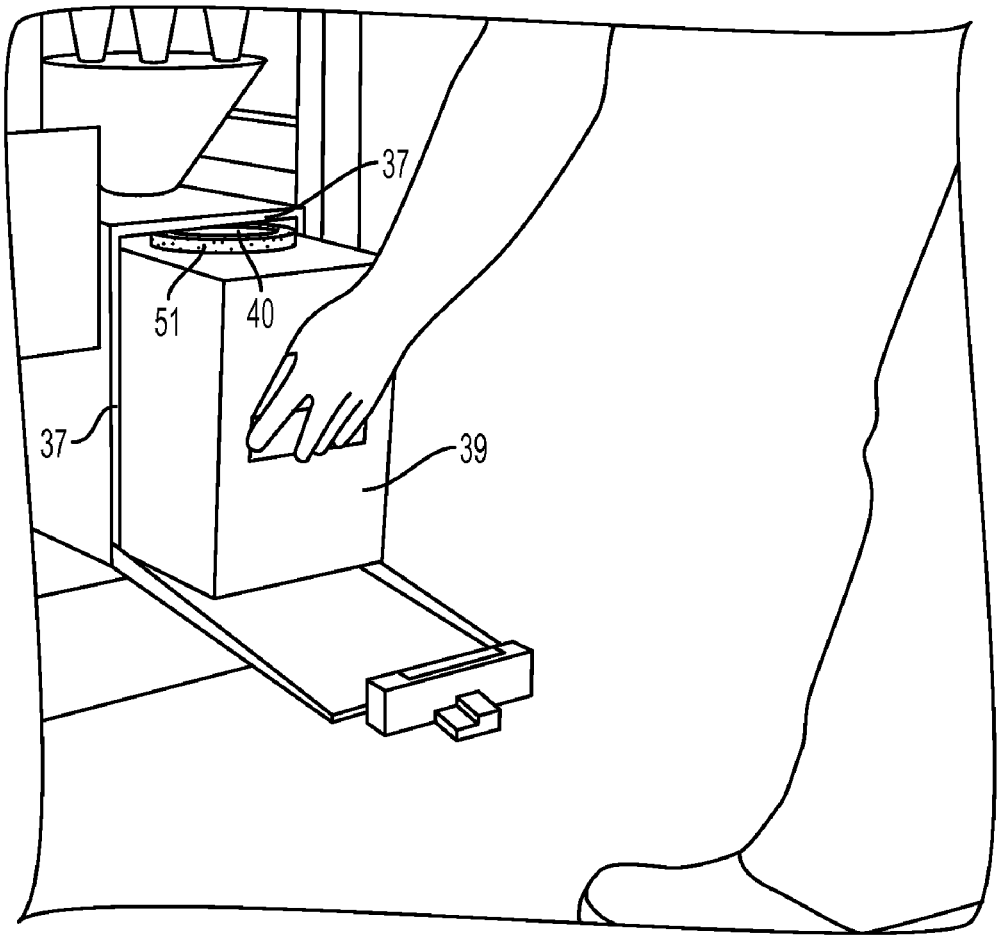
FIG. 7 is a perspective view of a carton container as it is being removed from the hermetically sealed outer box.

In FIG. 7 a carton container 39 is shown being removed from hermetically sealed outer box 37. Note that the porous ring 51 in this embodiment is attached to the top portion of carton container 39 around the opening 40 of the container 39. The opening 40 is immediately below the outlet of funnel 38 during use when collecting waste toner. The ring 51 can also be part of the outer box 37, as shown in FIG. 6.

Figure 8:
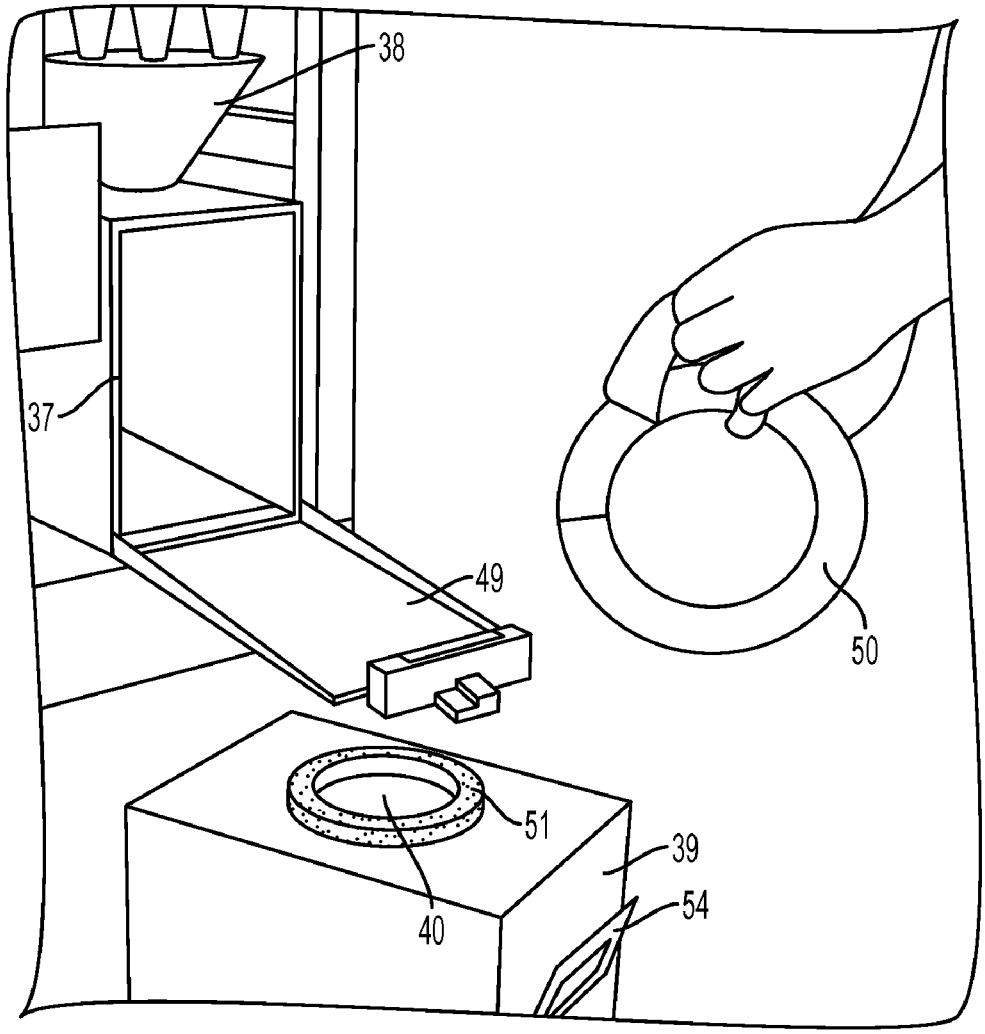
FIG. 8 is a perspective view of the container after it was removed from the outer box as a container lid is being prepared to cover the opening in the full container ready to be disposed.

In FIG. 8 the full container 39 is shown after it has been removed from the hermetically sealed outer box 37. A lid 50 is being prepared to cover opening 40 of the container 39 to fit around the porous ring or material 51.

Figure 9:
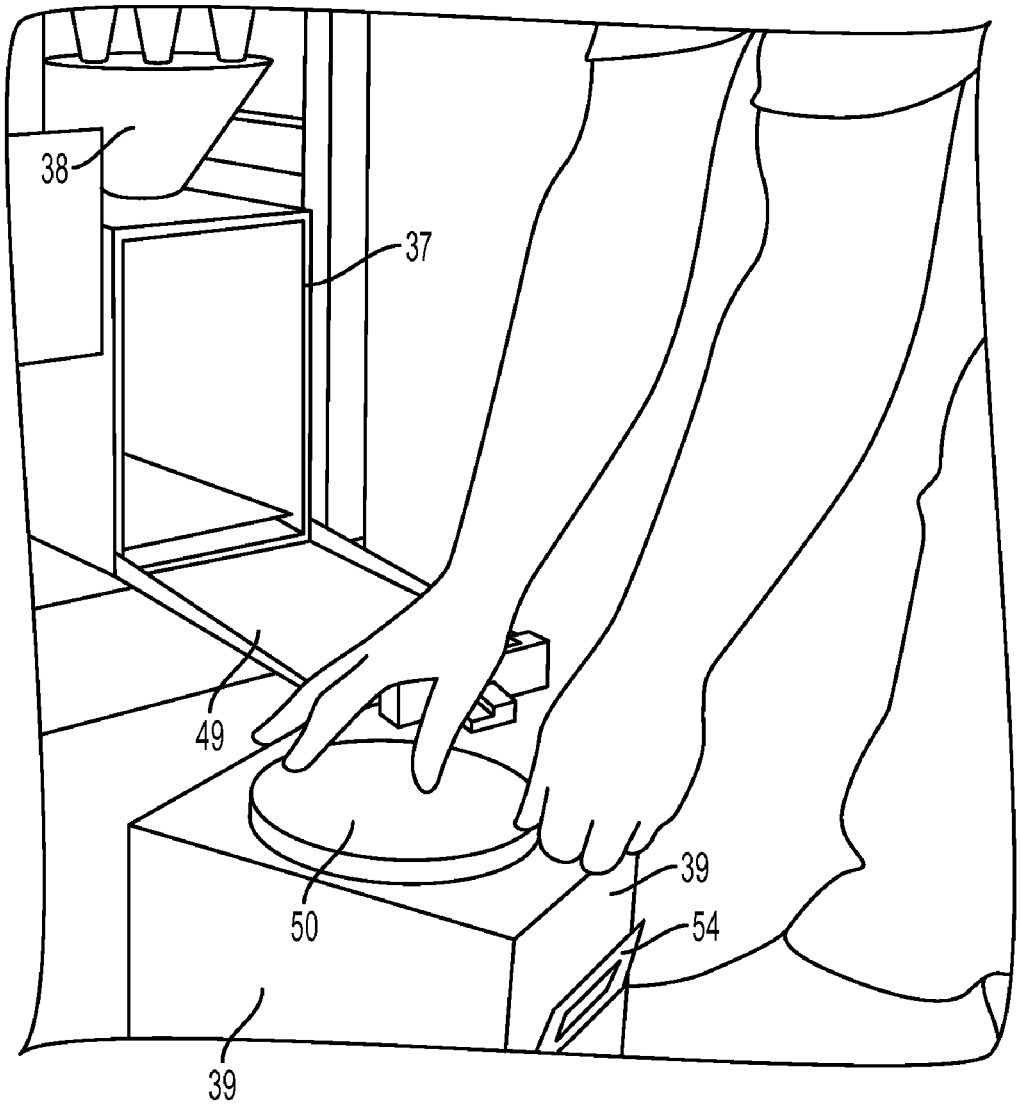
FIG. 9 shows the container lid in place closing the full container ready to be disposed.

In FIG. 9 the lid 50 is shown covering opening 40 of the toner full biodegradable container 39 reading it for disposal. A handle 54 can be used on both the bag or carton containers to make them easier to remove from outer box 37.

In summary, this invention provides an electrophotographic marking system comprising a cleaning station and a developer station, the developer station comprises a waste toner dispenser unit. This unit comprises collection tubes that are configured to convey waste toner from both the developer station and the cleaning station to a waste collection assembly. This assembly comprises a funnel portion configured to feed waste toner to the toner waste collection assembly. The assembly comprises in the marking system a hermetically sealed stationary, non-removable outer box housing having a removable biodegradable container therein that is configured to collect waste toner and be removable when filled with the waste toner.

This system in one embodiment comprises a plurality of xerographic structures each having at least one collection tube. In another embodiment, the system is a color marking system comprising a plurality of color stations; each of the stations comprises at least one collection tube.

When the system is a monochromatic marking system, it has at least one collection tube. The waste collection assembly of this invention is configured to be easily retrofitted into existing electrophotographic marking systems.

The system is configured to transport waste toner into the container housed in the outer box while using the hermetically sealed outer box to prevent any pressure existing in the waste collection assembly to affect the container.

The waste collection assembly of this invention comprises a controller, collection tubes running from an electrophotographic marking station to a toner collection funnel in the assembly. The toner collecting funnel connects the collection tubes to the assembly. This funnel is configured to transport waste toner to a replaceable container that is housed in a hermetically sealed non-removable outer box. This hermetically sealed outer box is configured to prevent any assembly pressure to enter an interior of the box. The container has an opening at its upper section that is configured to permit passage of waste toner therein; this opening is contiguous with the funnel. The container is located above a weight scale which is configured to indicate when the container is filled with waste and needs to be replaced. The hermetically sealed outer box has a door configured to be opened when the container is to be removed or inserted into the box. The container and outer box have a porous material placed around the opening adjacent the funnel. This porous material prevents toner contamination of the outer box. The assembly is configured to transport waste toner into the pressurized collection assembly in an interior of the hermetically sealed outer box.

In one embodiment, a motor is connected to the controller. This motor is configured to both energize the collection assembly and shut down the assembly when the container requires removal.

It will be appreciated that variations of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

What is claimed is:

1. An electrophotographic marking system comprising: a cleaning station; and a developer station, wherein said developer station comprises a waste toner dispensing unit, said waste toner dispensing unit comprises collection tubes configured to convey waste toner from both said developer station and said cleaning station to a waste collection assembly, said waste collection assembly comprises a funnel portion configured to feed waste toner to a toner waste collection assembly, said waste collection assembly comprises, in said electrographic marking system, a hermetically sealed non-removable outer box having therein a removable biodegradable container that is configured to collect waste toner and be removable when filled with said waste toner, said removable biodegradable container has an opening that is configured to permit passage of waste toner therein, said opening is contiguous with said funnel, said opening has a porous material located between said opening and said funnel, and said porous material is configured to allow at least 98% of said waste toner to pass through the opening into the removable biodegradable container.

2. The electrographic marking system of claim 1, wherein said electrographic marking system comprises a plurality of xerographic structures each having connectivity to at least one of said collection tubes.

3. The electrographic marking system of claim 1, wherein said electrographic marking system is a color marking system comprising a plurality of color stations, each station having connectivity to at least one of said collection tubes.

4. The electrographic marking system of claim 1, wherein said electrographic marking system is a monochromatic marking system having connectivity to at least one of said collection tubes.

5. The electrographic marking system of claim 1 wherein said electrographic marking system is configured to transport waste toner into said removable biodegradable container housed in said hermetically sealed non-removable outer box while using said hermetically sealed non-removable outer box to prevent any pressure existing in said waste collection assembly to affect said removable biodegradable container.

6. A toner waste collection assembly comprising a controller; and collection tubes running from an electrophotographic marking station to a toner collection funnel in said toner waste collection assembly, wherein said toner collection funnel connects said collection tubes to said toner waste collection assembly, said toner collection funnel is configured to transport waste toner to a replaceable container that is housed in a hermetically sealed non-removable outer box, said hermetically sealed non-removable outer box is configured to prevent any toner waste collection assembly pressure to enter an interior of said hermetically sealed non-removable outer box, said replaceable container has an opening that is configured to permit passage of waste toner therein, said opening is contiguous with said toner collection funnel, said opening has a porous material located between said opening and said toner collection funnel, and said porous material is configured to allow at least 98% of said waste toner to pass through the opening into the removable replaceable container.

7. The toner waste collection assembly of claim 6, wherein said replaceable container is located above a weight scale, said weight scale configured to indicate when said replaceable container is filled with waste toner and needs to be replaced.

8. The toner waste collection assembly of claim 6, wherein said hermetically sealed non-removable outer box has a door configured to be opened when said replaceable container is to be removed or inserted into said hermetically sealed non-removable outer box.

9. The toner waste collection assembly of claim 6, configured to transport waste toner into a pressurized collection assembly in an interior of said hermetically sealed non-removable outer box.

10. The toner waste collection assembly of claim 6, wherein a weight scale is positioned below said replaceable container and the weight scale is configured to indicate the weight of said replaceable container and said waste toner.

11. The toner waste collection assembly of claim 6, wherein a motor is connected to said controller, and said motor is configured to both energize said toner waste collection assembly and shut down said toner waste collection assembly when said replaceable container requires removal.

12. The toner waste collection assembly of claim 6, wherein an air space is provided between an outer section of said replaceable container and an inner section of said hermetically sealed non-removable outer box.

13. A method for collecting waste toner of an electrophotographic marking system, said method comprising:

providing in said electrophotographic marking system a toner waste collection assembly;

passing waste toner from at least one of a developer station and a cleaning station of said electrophotographic marking system to a funnel of said waste collection assembly;

providing in said waste collection assembly a non-removable hermetically sealed outer box;

providing in said non-removable hermetically sealed outer box a removable biodegradable container that is configured to collect said waste toner and be removable from said non-removable hermetically sealed outer box when filled with said waste toner;

opening said non-removable hermetically sealed outer box to remove said removable biodegradable container;

covering or sealing an inlet in said removable biodegradable container with a lid or cover; and disposing said removable biodegradable container when full and sealed, wherein said removable biodegradable container has an opening that is configured to permit passage of waste toner therein, said opening is contiguous with said funnel, said opening has a porous material located between said opening and said funnel, and said porous material is configured to allow at least 98% of said waste toner to pass through the opening into the removable biodegradable container.

14. The method of claim 13, wherein said removable biodegradable container is in the form of a carton or bag, said container is positioned above a weight scale, and said weight scale is configured to indicate when said removable biodegradable container is filled with waste toner and should be replaced.

15. The method of claim 14, wherein a controller is connected to said weight scale and is configured to both energize said toner waste collection assembly and shut down said toner waste collection assembly when said removable biodegradable container is full.

16. The method of claim 13, wherein a pressure is maintained on an interior of said non-removable hermetically sealed outer box around a space between said non-removable hermetically sealed outer box and said removable biodegradable container.

* * * * *